US005274389A

United States Patent [19]

Archer et al.

[11] Patent Number: 5,274,389

[45] Date of Patent: Dec. 28, 1993

[54] BROADBAND DIRECTION FINDING SYSTEM

[75] Inventors: Donald H. Archer; Kim McInturff; Alfred I. Mintzer; Wilbur H. Thies, all of Santa Barbara, Calif.

[73] Assignee: Raytheon Company, Lexington, Mass.

[21] Appl. No.: 990,817

[22] Filed: Dec. 14, 1992

Related U.S. Application Data

[63] Continuation of Ser. No. 794,592, Nov. 13, 1991, abandoned, which is a continuation of Ser. No. 541,667, Jun. 21, 1990, abandoned.

[51] Int. Cl.[5] ..... H01Q 3/30; H01Q 15/04; H01Q 21/20; H01Q 21/22

[52] U.S. Cl. ..... 343/754; 342/437; 343/844; 343/853

[58] Field of Search ..... 342/427, 432, 437, 429, 342/417; 343/754, 853, 703, 844, 824, 792.5

[56] References Cited

U.S. PATENT DOCUMENTS

| | | | |
|---|---|---|---|
| 3,560,985 | 2/1971 | Lyon | 343/853 |
| 3,568,207 | 3/1971 | Boyns et al. | 343/754 |
| 3,680,137 | 7/1972 | Wright | 343/754 |
| 3,754,270 | 8/1973 | Thies, Jr. | 343/754 |
| 3,827,055 | 7/1974 | Bogner et al. | 343/754 |
| 4,103,304 | 7/1978 | Burnham et al. | 342/427 |
| 4,145,696 | 3/1979 | Gueguen | 343/792.5 |
| 4,641,144 | 2/1987 | Prickett | 343/754 |
| 4,931,808 | 6/1990 | Lalezari et al. | 343/753 |

OTHER PUBLICATIONS

Boyns et al., Step-Scanned Circular-Array Antenna, IEEE Trans. on Antennas and Prop., vol. AP-18, No. 5, Sep. 1970, pp. 590-595.

Archer, D. Lens-Fed Multiple Beam Arrays, Microwave Journal Oct. 1975 pp. 37-42.

*Primary Examiner*—William Mintel
*Assistant Examiner*—Peter Toby Brown
*Attorney, Agent, or Firm*—Richard M. Sharkansky

[57] ABSTRACT

An amplitude monopulse direction finding system is disclosed. The system is built around a circular array with a circular lens in which the antenna elements and array ports are larger than in conventional systems. The oversized antenna elements and array ports provide a wide range of operating frequencies for the direction finding system. Additionally, the direction finding system contains an omni-directional probe at the center of the lens to detect the presence of signals. In an alternative embodiment, each array port is split into two halves which can be combined in different ways to produce different beam patterns, allowing the beam pattern providing the best signal to noise ratio to be selected. Also, built-in-test circuitry is described.

21 Claims, 5 Drawing Sheets

BROADBAND DIRECTION FINDING SYSTEM

This application is a continuation of application Ser. No. 794,592, filed Nov. 13, 1991, and now abandoned; which is a continuation of Ser. No. 541,667, filed Jun. 21, 1990, and now abandoned.

BACKGROUND OF THE INVENTION

This invention relates generally to radio frequency energy (RF) systems and more particularly to systems which determine the direction from which an RF signal is received.

Direction finding systems have been employed for many purposes. One widely used technique for direction finding is called "amplitude monopulse".

A multibeam amplitude monopulse system receives a plurality of evenly spaced beams of RF energy (hereafter simply "beams"). The center of each beam is associated with a given direction. When a signal is received in one beam, the angle associated with that beam gives a coarse indication of the direction from which the signal is impinging on the antenna.

To get a finer measurement of the direction of the signal, adjacent beams overlap so that each signal falls into two beams. The relative strength of the signal in each beam indicates the angular difference between the direction of signal and the center of the beams. Thus, the direction of the signal can be precisely determined.

A direction finding system must provide receive beams covering every direction in which a signal of interest might be received. Conventional systems often must provide receive beams in all directions—what is called 360° coverage. To provide 360° coverage, conventional systems contain at least four array antennas. Each of the antennas covers a different sector of the 360° coverage area.

One shortcoming of such an arrangement is the amount of components needed to construct the system. For example, each antenna element in each of the array antennas requires a low noise amplifier. Such amplifiers are costly.

The problem is further compounded if the direction finding system must work on signals over a relatively wide range of frequencies. Basically, the accuracy of the direction finding measurement depends on the width of the received beams in combination with the spacing between the direction of adjacent beams. The width of the receive beam decreases with increasing frequency. Thus, to have an acceptable accuracy on the direction finding measurement, the spacing between the beams must be decreased to operate the direction finding system.

To decrease the spacing between adjacent beams, the antenna array is made longer. Since the spacing between elements must be less than one-half of a wavelength to avoid grating lobes, more antenna elements are added to each array to make the array longer.

Of course, when a direction finding system contains a plurality of linear arrays, it is not possible to add single antenna elements to improve the operating bandwidth of the system. One antenna element must be added to each array, meaning at least four antenna elements are added at a time in a system which provides 360° coverage.

Moreover, the gain of a linear array is proportional to the length of the array. The number of elements might need to be further increased to provide adequate gain.

An additional shortcoming of a direction finding system with linear arrays is called "coning error". Briefly, coning error results because of the geometrical interaction between the azimuth and elevation lines-of-sight at azimuth angles off broadside. Thus, the measured azimuth angle will deviate from the true azimuth angle as the elevation angle increases.

SUMMARY OF THE INVENTION

With the foregoing background in mind, it is an object of this invention to provide a reduced cost direction finding system.

It is also an object to provide a direction finding system which operates over a wide frequency range.

It is a further object to provide a direction finding system with a reduced number of antenna elements.

Another object of this invention is to provide a direction finding system with a reduced number of elements while maintaining the gain of the antenna.

It is yet a further object to provide an 360° azimuth multibeam antenna which operates over a wide frequency range.

It is also an object of this invention to provide a direction finding system which does not suffer from "coning error".

The foregoing and other objects are achieved in an amplitude monopulse direction finding system with a circular array antenna fed by a circular lens. Rather than employing antenna array elements spaced by one-half wavelength or less, as in conventional systems, the antenna elements of the invention are spaced greater than one-half wavelength. The beam ports and array ports of the lens are likewise increased in size over conventional lenses.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
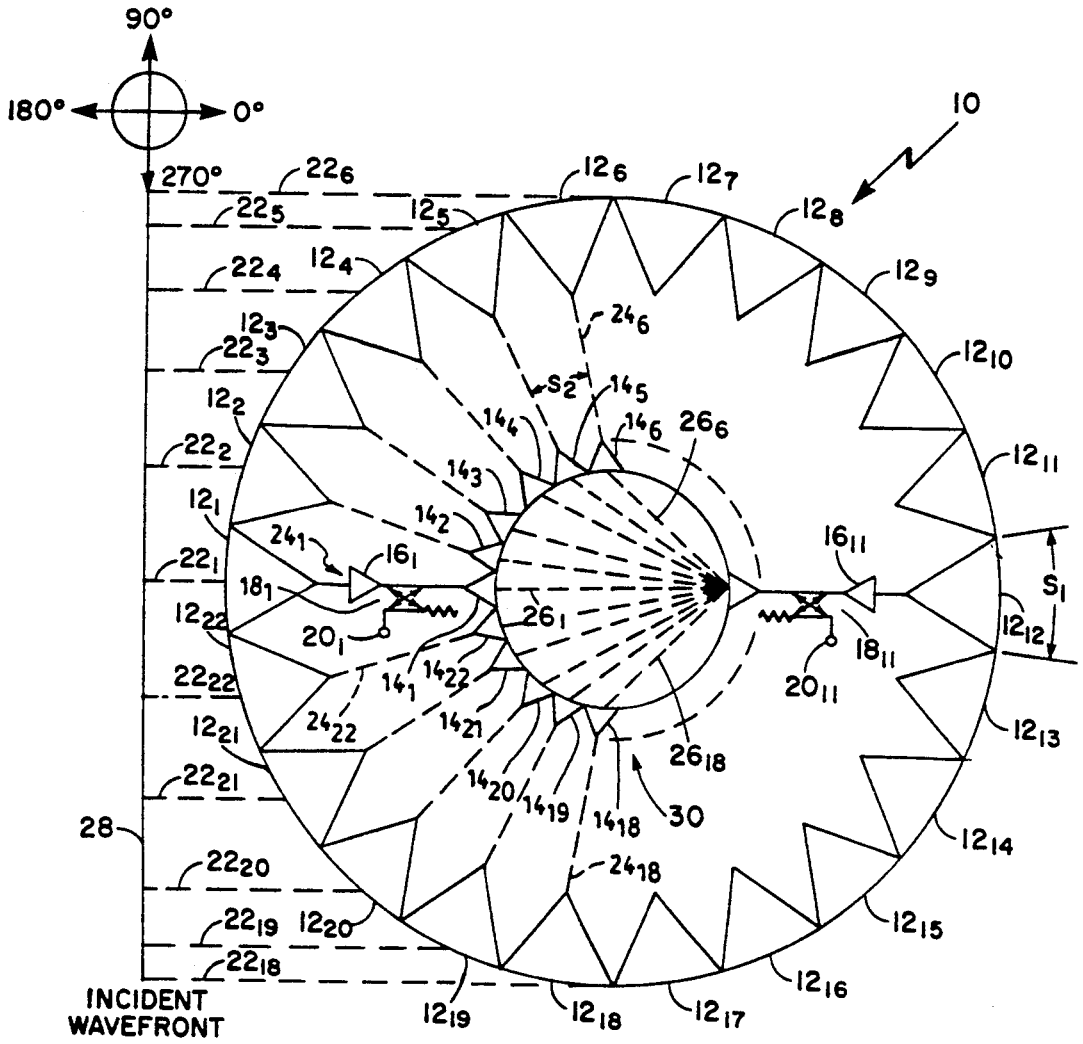
FIG. 1 is a amplified schematic diagram of an antenna array used in the present invention.

The direction finding system of the present invention employs a circular antenna array such as the one depicted in FIG. 1. The circular antenna array 10 has a plurality, here 22, of antenna elements $\mathbf{12}_1 \ldots \mathbf{12}_{22}$. The antenna elements $\mathbf{12}_1 \ldots \mathbf{12}_{22}$ are arranged in a circle. Each of the antenna elements is constructed in a known fashion. Here, horn radiators are arranged in a circle roughly 16 inches in diameter.

At the center of the circle of antenna elements is a circular lens 30 comprising a circle of array ports $\mathbf{14}_1$.

. . $14_{22}$. Array ports are conventionally used in electromagnetic lenses and array ports $14_1$ . . . $14_{22}$ are constructed using known techniques. Each of the antenna elements $12_1$ . . . $12_{22}$ is coupled to one of the array ports $14_1$ . . . $14_{22}$. Here, the coupling is through a conducting path containing an amplifier $16_1$ . . . $16_{22}$ (with only amplifiers $16_1$ and $16_{11}$ being shown).

Each of the array ports $14_1$ . . . $14_{22}$ also doubles as a beam port. One of the couplers $18_1$ . . . $18_{22}$ (with only couplers $18_1$ and $18_{11}$ shown) is connected to each of the array ports $14_1$ . . . $14_{22}$ to form an output port $20_1$ . . . $20_{22}$ (with only output ports $20_1$ and $20_{11}$ shown for clarity).

Circular array antennas are described generally in U.S. Pat. No. 3,754,270. With the exceptions noted herein, the construction techniques described in that patent are applicable to the construction of an antenna array for the present invention. Basically, the spacing of the antenna elements and array ports and the dielectric constants of the materials used to construct the lens are all appropriately chosen so that a signal arriving from a particular direction is focused to a particular one of the array ports $14_1$ . . . $14_{22}$.

FIG. 1 shows an incident wavefront 28 arriving from an angle relative to the antenna denoted 180°. Because of the circular nature of the antenna, wavefront 28 will propagate to one-half of the antenna elements in the array. The propagation paths $22_1$ . . . $22_6$ and $22_{18}$ . . . $22_{22}$ are of differing lengths and wavefront 28 will arrive at the various antenna elements $12_1$ . . . $12_6$ and $12_{18}$ . . . $12_{22}$ at different times. The paths $24_1$ . . . $24_6$ and $24_{18}$ . . . $24_{22}$ from the antenna elements are all the same length and no relative phase delay is introduced along paths $24_1$ . . . $24_6$ and $24_{18}$ . . . $24_{22}$.

The paths $26_1$ . . . $26_6$ and $26_{18}$ . . . $26_{22}$ across the circle formed by the array ports are of different lengths. The lens is constructed so that the signals in the various paths arrive at array port $14_{11}$ at the same time (i.e., "in phase"). To ensure the signals all arrive in phase, the electrical length of path $26_{18}$ plus the electrical length of path $22_{18}$ must equal the sum of the electrical length of path $22_1$ and $26_1$. As described in the aforementioned U.S. patent, this result is achieved by appropriate selection of element spacing and the dielectric constant of the material from which the lens is fabricated.

The signal is focused at array port $14_{11}$, passes through coupler $18_{11}$, and can be received at output port $20_{11}$. The signal at output port $20_{11}$ represents one received beam for an angle of 180°. The signals at each of the other output ports $20_1$ . . . $20_{22}$ (only $20_1$ and $20_{11}$ shown) represent signals received in other beams corresponding to signals arriving from other angles.

To complete the direction finding system, the signals in the received beams are passed to receivers (not shown) of known type. More specifically, the signals at adjacent output ports—such as output ports $20_{11}$ and $20_{12}$—are passed through switches (not shown) of known type to receivers (not shown). The magnitude of the received signals are compared to produce, according to known amplitude monopulse techniques, an indication of the direction from which the incident wavefront impinged on the system.

Use of a circular array in a direction finding system provides an advantage in that it does not suffer from coning error. It will be appreciated that the circular array, appearing substantially identical when viewed from every angle, has a receive beam pattern which is insensitive to the angle of arrival of the signal. Thus, coning error will not result.

The antenna array of FIG. 1 also provides an advantage in that it operates over a wide bandwidth. Here, the systems operate over a 9:1 frequency band (roughly 2.0 to 18 GHz). It is known that conventional direction finding systems fail to operate over wide bandwidths because their beam widths decrease at higher frequency. Here, the dimensions $S_1$ and $S_2$ are selected to provide relatively constant beamwidths over the required frequency band.

The selection of dimensions $S_1$ and $S_2$ may be understood from principles of antenna theory. Basically, the width of a beam produced—either from a single element or an array of elements—decreases with increasing frequency and with increasing length of the element or array. Moreover, the beam pattern produced by an array is the product of the pattern characteristic of the array and of the pattern characteristic of each element of the array.

For the antenna of FIG. 1, the width of the beam patterns associated with antenna elements $12_1$ . . . $12_{22}$ decrease with increasing frequency. However, the width of the pattern associated with the array ports $14_1$ . . . $14_{22}$ also decreases. This decrease in width means that the signals from antenna elements near the "ends" of array are attenuated as the frequency of the signal increases. As shown in FIG. 1, antenna elements $12_6$ and $12_{18}$ are at the "ends" of the array for receiving wavefront 28. As the frequency of the received signal increases, the signals in paths $26_1$, $26_2$, and $26_{22}$ will be received with much greater strength than signals in paths $26_6$ and $26_{18}$. To a close approximation, at higher frequencies, it is as if antenna elements $24_6$ and $24_{18}$ are not in the array. Effectively, the antenna array gets shorter at higher frequencies. Thus, the array pattern gets wider at higher frequencies.

As stated previously, the beamwidth of an antenna array is the product of the pattern of the array and the pattern of the individual antenna elements. Here, the pattern associated with each element is decreasing while the pattern associated with the array is increasing. In an ideal case, the patterns of the array and the elements can be chosen so that the decrease in beamwidth associated with the antenna elements substantially cancels the increase in beamwidth associated with the array pattern.

To provide the required beam patterns, the antenna elements $12_1$ . . . $12_{22}$ have lengths, indicated by $S_1$, equalling 3.5 wavelengths at the highest operating frequency of the antenna. It is known that the array ports of circular lens 30 should have an electrical length roughly 1.9 times the electrical length of the 12 antenna elements $12_1$ . . . $12_{22}$. Thus, array ports $14_1$ . . . $14_{22}$ have lengths $S_2$ equal to $1.9 \times 3.5$ wavelengths, or roughly 6.65 wavelengths.

One might note that the lengths $S_1$ and $S_2$ are physically different, with $S_2$ being physically shorter than $S_1$. However, antenna elements $12_1$ . . . $12_{22}$ are in free space while array ports $14_1$ . . . $14_{22}$ are in a dielectric medium with a relative dielectric constant of approximately 4. Thus, a wavelength is shorter when measured at array ports $14_1$ . . . $14_{22}$ than at antenna elements $12_1$ . . . $12_{22}$.

One might also note that a spacing between antenna elements of 3.5 wavelengths exceeds the conventional upper limit of one-half of a wavelength. In a linear array, a spacing of elements exceeding one-half of a wavelength produces what are commonly called "grating lobes". Grating lobes are particularly harmful in a direction finding system because they create ambiguities in measuring the angle of arrival of signals. It has been discovered that the extra wide spacing of antenna elements $12_1 \ldots 12_{22}$ in the circular array of the invention does not, however, create grating lobes. Rather, the separate beams formed by the circular array merely have higher sidelobes than beams formed from an array with conventional spacing between the antenna elements.

Figure 2:
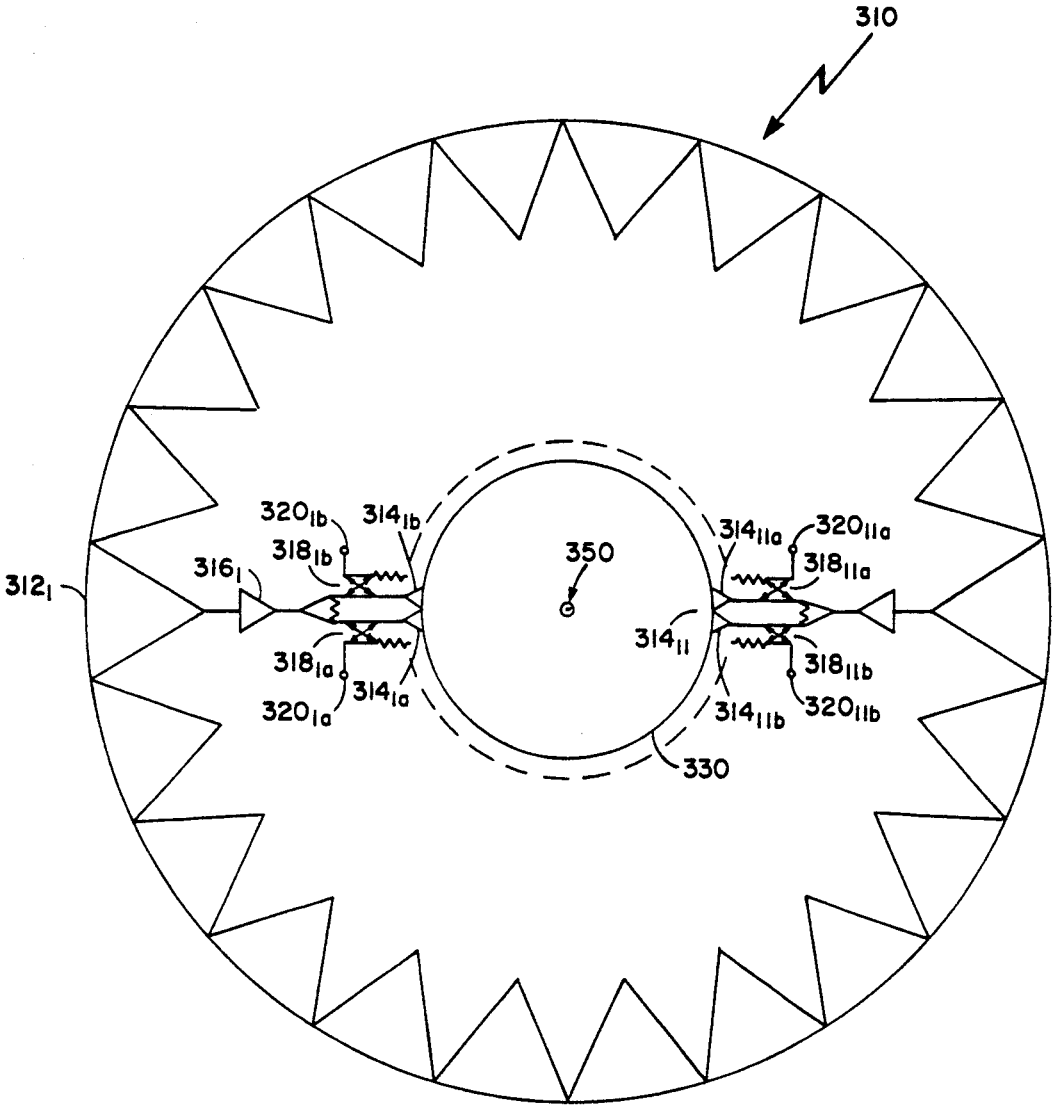
FIG. 2 is a simplified schematic of an alternative embodiment of an antenna array which can be used with the invention.

The large sidelobes are not necessarily a problem to a direction finding system. Moreover, techniques can be used to ignore signals received in the sidelobe of the antenna array. FIG. 2 illustrates one such technique. In FIG. 2, a circular array 310 is shown with a circular lens 330. In the center of circular lens 330, an omni-directional probe 350 is placed. Omni-directional probe 350 is coupled to a receiver which measures the strength of any RF signal at omni-directional probe 350.

Omni-directional probe 350 is small enough that it does not significantly disrupt the operation of circular lens 330. Thus, any signal in lens 330 normally focused at one of the array ports $314_1 \ldots 314_{22}$ (only two shown) will still be received at that array port. However, the signal from omni-directional probe 350 allows a determination of whether the signal at an array port is in the beam associated with that array port or merely a signal received in a sidelobe.

This determination can be understood if it is noted that a signal in the sidelobe of one of the plurality of beams will be in one of the other beams. Thus, the full strength of any signal impinging on circular array 310 will be received by omni-directional probe 350. If the signal received by omni-directional probe 350 is significantly larger (after factoring into the received signal strength the gain of the omni probe) than a signal measured at one of the array ports $314_1 \ldots 314_{22}$, it is known that the signal at the array port was received in the sidelobe of a beam. It is only when the signal received at one of the array ports $314_1 \ldots 314_{22}$ has a strength on the same order of magnitude as the signal received at omni-directional probe 350 that it is known the signal at the array port was received in the beam associated with that array port. Thus, the signals received in the sidelobes can be identified and ignored.

Use of omni probe 350 provides a simple way of determining whether a receiver (not shown) is connected to the array port receiving a signal in its main beam. Significantly, this determination is made without the need for switching a receiver to all of the array ports.

Figure 3A:
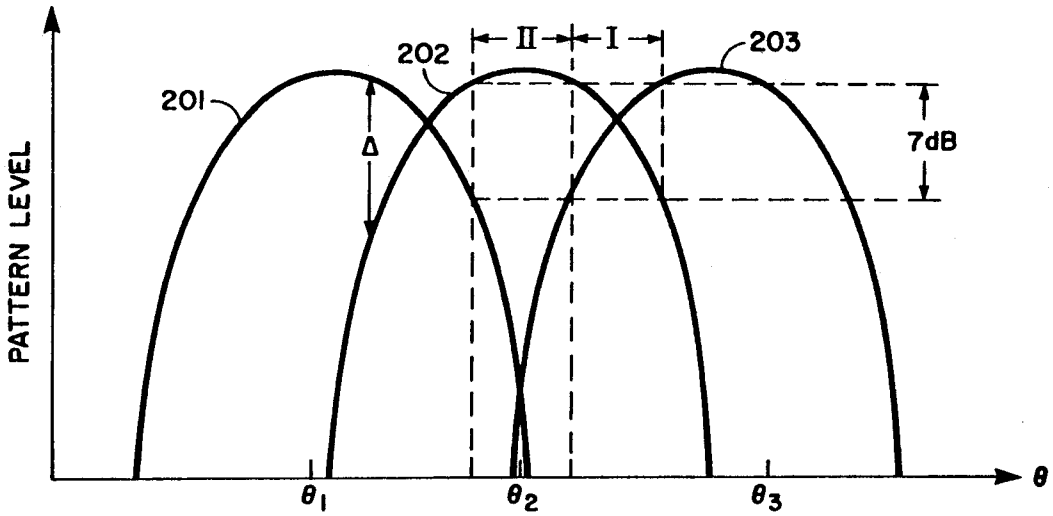
FIG. 3A is a graph depicting three of the beams received with the antenna array of FIG. 1.
Figure 3B:
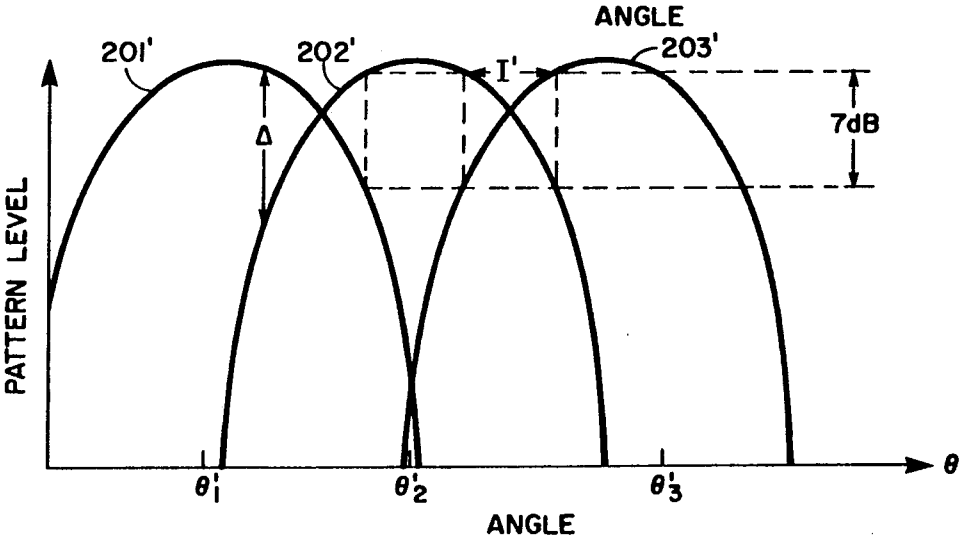
FIG. 3B is a graph depicting three of the beams received using an alternative embodiment of the invention.

FIGS. 3A and 3B show a benefit of an alternative embodiment of the invention. FIG. 3A shows a plot of the beam patterns received at three adjacent array ports. For example, beam pattern 201 could be the beam pattern received at array port $14_1$; beam pattern 202 could be the beam pattern received at array port $14_2$; and beam pattern 203 could be the beam pattern received at array port $14_3$. As described previously, the angle of arrival of signals impinging on the circular array 10 (FIG. 1) from angles between $\theta_1$ and $\theta_2$ are determined by comparing the strengths of signals received in beams 201 and 202. Likewise, for signals from angles between $\theta_2$ and $\theta_3$, the strengths of signals received at beams 202 and 203 are compared. The angles $\theta_1$, $\theta_2$, $\theta_3$, etc. define ranges of angles.

FIG. 3A shows the angles between $\theta_2$ and $\theta_3$ divided into two regions; Region I and Region II. In Region I, the beam patterns between adjacent beams differ by less than 7 dB. In Region II, the beam patterns differ by more than 7 dB. Thus, when a signal is received from an angle in Region II, the signal strength received in adjacent beams will differ by more than 7 dB. This large signal difference may create problems since the level of the smaller signal will be affected by noise to a greater extent. It can be seen, then, that more accurate measurements can be made if the received signal always falls in Region I (i.e., the signal strength in adjacent received beams differs by less than 7 dB).

FIG. 2 shows an adaptation to circular lens 30 which can achieve this result. In particular, each of the array ports $314_1 \ldots 314_{22}$ (only two of which are explicitly shown) are divided into two sections. For example, array port $314_1$ contains array port halves $314_{1a}$ and $314_{1b}$. Each of the array port halves is one-half the size of the array ports in FIG. 1. Here, the array port halves would be 3.33 wavelengths at the highest operating frequency of the system.

Each of the array port halves is connected to a coupler. For example, array port halves $314_{1a}$ and $314_{1b}$ are connected to couplers $318_{1a}$ and $318_{1b}$, respectively. The array port halves making up one array port are coupled through an amplifier, such as amplifier $316_1$, to an antenna element, such as antenna element $312_1$.

Each of the couplers is connected to an output port, such as output ports $320_{1a}$ and $320_{1b}$. To make a beam such as would be received at one of the array ports $14_1 \ldots 14_{22}$ of FIG. 1, the signals from two array port halves are combined. For example, to create a signal such as would be received at array port $14_1$ (FIG. 1), the signals received at array port halves $314_{1a}$ and $314_{1b}$ are combined.

However, it is also possible to create a pattern other than what is achieved with the array ports of FIG. 1. FIG. 3 shows an alternative beam pattern that can be achieved with the apparatus of FIG. 2. The beams 201', 202', and 203' are formed by combining signals from array port halves of different array ports. For example, beam 202' is formed by combining the signal from array port half $314_{1b}$ with the signal from array port half $314_{2a}$. Likewise, beam 203' is formed by combining the signal from array port half $314_{2b}$ with the signal from array port half $314_{3a}$.

It is important to note that for angles in Region II in FIG. 3A, the angles in FIG. 3B fall into region I'. By appropriately choosing to combine signals to produce the beam pattern of FIG. 3A or FIG. 3B, it is possible to ensure that the signal will fall into a Region I or I'. Thus, the signal received in adjacent beams will always differ by less than 7 dB.

Figure 4:
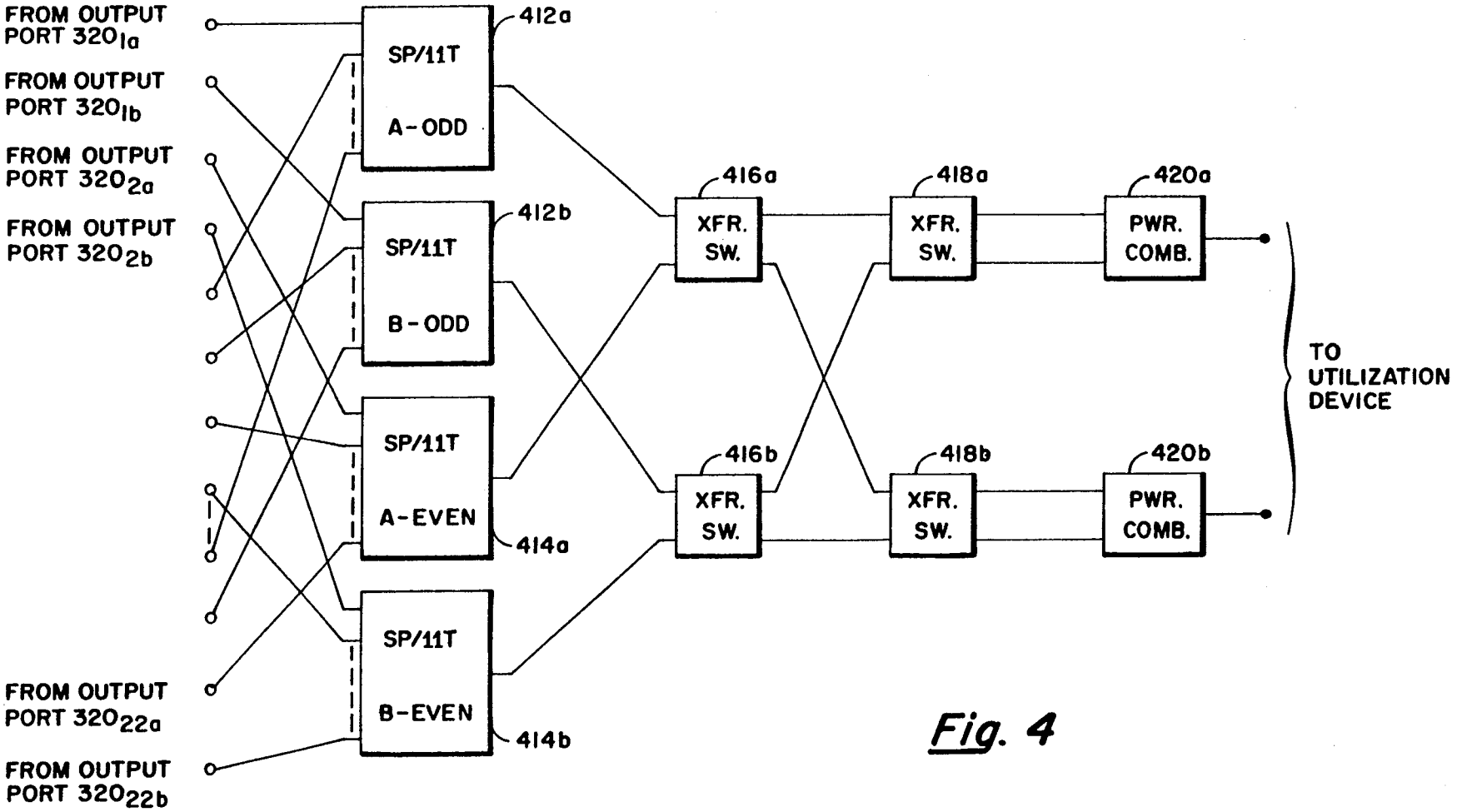
FIG. 4 is a simplified schematic of a switching network used in conjunction with the antenna of FIG. 3.

FIG. 4 shows a switching arrangement which allows the signals at output ports $320_{1a} \ldots 320_{22b}$ to be combined to form the beam patterns of either FIG. 3A or FIG. 3B. The switching circuit of FIG. 4 is constructed from elements commonly used in radio frequency systems. The elements are controlled by control circuitry (not shown) of the type which is also commonly used in RF systems.

Each of the output ports $320_{1a} \ldots 320_{22b}$ is connected to the input of one of four single pole, eleven throw switches 412*a*, 412*b*, 414*a*, and 414*b*. Every fourth array port half is connected to the same switch. In this way, any four array port halves can be selected to form two adjacent beams. Transfer switches 416*a*, 416*b*, 418*a*, 418*b* allow the signals from the four selected array port halves to be applied to power combiners 420a and 420b to form two signals.

Transfer switches 416a, 416b, 418a, and 418b are constructed using known techniques. Basically, each transfer switch has two inputs, two outputs, and a control input (not shown). With the control input in a first state, the first input is coupled to the first output and the second input is coupled to the second output. With the control input in the second state, the first input is connected to the second output and the second input is connected to the first output.

For example, to form beams 202 and 203 of FIG. 3A, the signals from output ports $320_{2a}$ and $320_{2b}$ appear at the output of switches 414a and 414b, respectively. The signals from output ports $320_{3a}$ and $320_{3b}$ appear on the outputs of switches 412a and 412b. Transfer switches 416a, 416b, 418a, and 418b are set such that the signals from array port halves $320_{2a}$ and $320_{2b}$ are applied to power combiner $420_b$ to form beam 202. The signals from array port halves $320_{3a}$ and $320_{3b}$ are applied to power combiner $420_a$ to form beam 203.

To form beams 202' and 203' of FIG. 3B, switches 412a, 412b, 414a, and 414b select the outputs from array port halves $314_{1b}$ . . . $314_{3a}$. Transfer switches 416a, 416b, 418a, and 418b operate to apply the signals from array port halves $314_{1b}$ and $314_{2a}$ to power combiner 420a and to apply the signals from array port halves $314_{2b}$ and $314_{3a}$ to power combiner $420_b$ to form beam pattern 203'.

The antenna array of FIG. 1 can also be incorporated into a modified system which allows testing of substantial portions of the direction finding system. Such modifications achieve what is commonly called "Built-in-Test".

Figure 5:
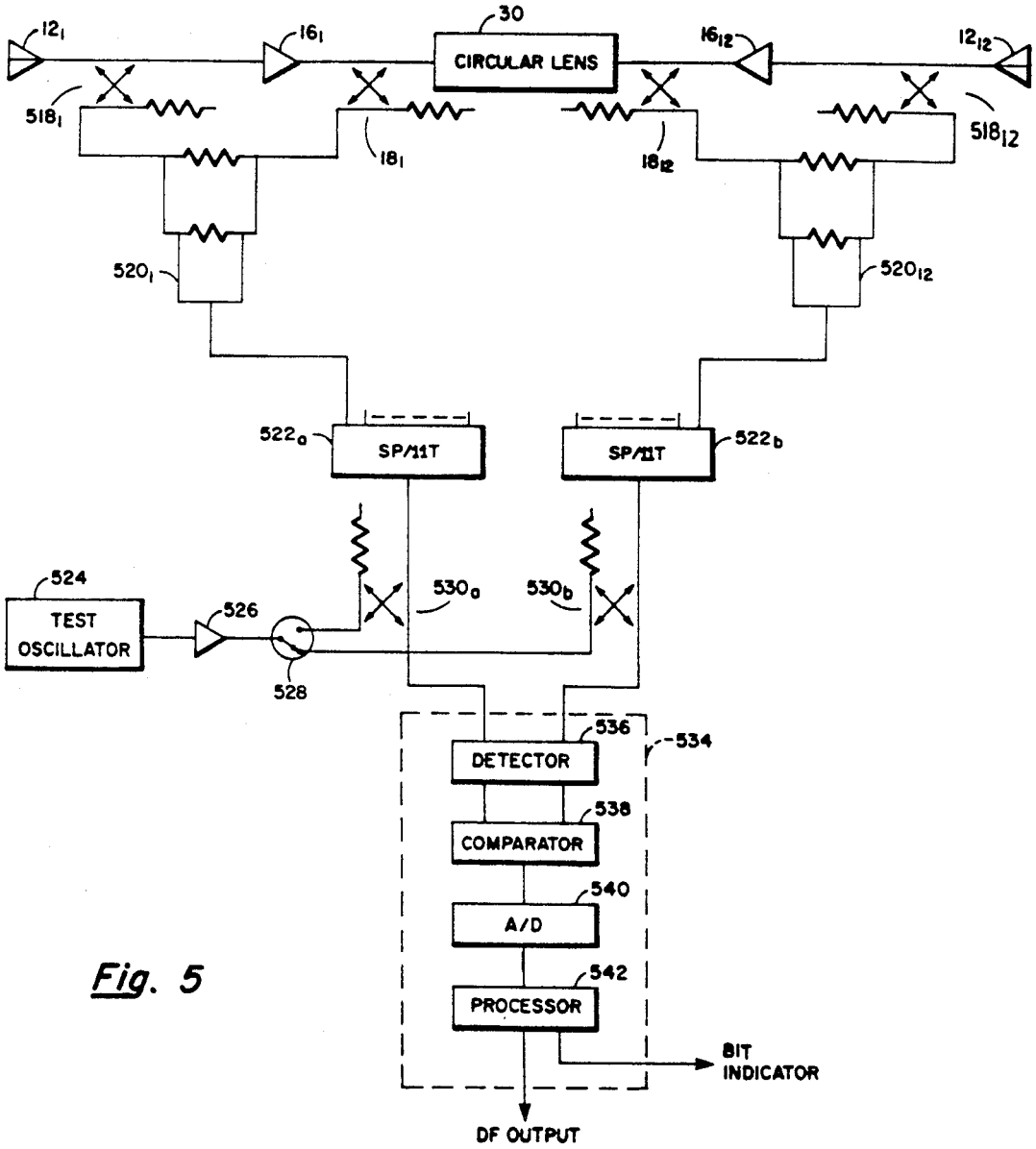
FIG. 5 is a simplified schematic of a built-in-test circuitry which can be used in conjunction with the present invention.

FIG. 5 shows in schematic form circular lens 30. As in FIG. 1, the array ports (not shown in FIG. 5) are coupled to antenna elements $12_1$ . . . $12_{22}$ (only two being shown in FIG. 5). The coupling is through one of the amplifiers $16_1$ . . . $16_{22}$ and one of the couplers $18_1$ . . . $18_{22}$. As described above, the signals out of the couplers $18_1$ . . . $18_{22}$ are connected to a switching network which allows the signals from any two adjacent array ports to be selected. Here, the switching network is shown to comprise two single pole, eleven throw switches 522a and 522b. Every other array port is coupled to the same switch such that the signals from adjacent array ports can be switched to the outputs of different switches. Here, the outputs of switches 522a and 522b are fed to a monopulse receiver/comparator where the signals are compared to produce an amplitude monopulse indication of the angle of arrival of any signal.

Test oscillator 524 is shown included in the switching network for built-in-test. Test oscillator 524 produces a test signal which is coupled through amplifier 526 and switch 528 to either coupler 530a or 530b. The selected coupler couples the test signal to one of the switches 522a or 522b. The signal passes through the selected switch to one of the signal splitters $520_1$ . . . $520_{22}$. From there, the signal passes through one of the couplers $518_1$ . . . $518_{22}$ to the input of one of the amplifiers $16_1$ . . . $16_{22}$. From the amplifier, the test signal is applied to one of the array ports of circular lens 30. The test signal then propagates through circular lens 30 to the other array ports of the lens.

One of the array ports is selected by the one of the switches 522a and 522b which did not receive the test signal. The test signal passes through the coupler $18_1$ . . . $18_{22}$ and the signal splitter $520_1$ . . . $520_{22}$ associated with the selected array port to the output switch. From the output switch, the test signal passes to monopulse receiver/comparator 534.

It will be noted that the second input to monopulse receiver 534 is coupled to the point—either coupler $530_a$ or $530_b$—where the test signal is injected. Thus, the two inputs of monopulse receiver/comparator 534 reflect the level of the test signal when it is injected into the system and the level of the test signal after it has propagated through the system.

As is known, monopulse receiver/comparators compare the levels of two signals. Detector 536 operates on the two inputs to the monopulse receiver/comparator in a known manner. Comparator 538 produces an analog signal indicative of the ratio between the input signals. The analog signal is converted to a digital signal in analog to digital converter 540 and applied to processor 542.

Processor 542 is any known digital processor. In normal operation, the inputs to monopulse receiver/comparator 534 represent signals received in adjacent beams. Processor 542 is programmed, in any known manner, to convert the output of analog to digital converter 540 to a value representing the angle of arrival of a signal impinging on the antenna.

When the system of FIG. 5 is being tested with the built-in-test function, the inputs to monopulse receiver 534 represent an input and an output test signal and the output of A/D analog to digital converter 540 represents the difference between these signals. Processor 542 is programmed to check the output of analog to digital converter 540. If the input and output test signals differ by the expected amount, processor 542 places a signal on the BIT INDICATOR line indicating the system of FIG. 5 is operating correctly. In contrast, if the input and output test signals differ by other than the expected amount, processor 542 places a signal on BIT INDICATOR LINE indicating a failure in the system.

An important feature of the built-in-test design is apparent from FIG. 5. Namely, few parts are added to the system to perform the built-in-test function. Test oscillator 524, amplifier 526, switch 528, and couplers 530a and 530b, and splitters $520_1$ . . . $520_{22}$ are added to allow injection of a test signal. However, the rest of the test is accomplished using components used by the system for direction finding. This arrangement minimizes the chance that the built-in-test will produce a BIT INDICATOR signal level indicating an error when the only error is in the components used to test the system.

For example, in operation a controller (not shown) activates test oscillator 524. Switch 528 is selected by the controller as the input switch and switch 528 couples the test signal to switch 522a. Switch 522a couples the signal through splitter $520_1$ and coupler $518_1$ to amplifier $16_1$. The amplified signal is applied to array port $14_1$ (FIG. 1).

Switch 522b acts as the output switch and selects the signal from array port $14_{12}$ (FIG. 1). The signal from the output switch is then applied to monopulse receiver/detector 536 and hence to comparator 538.

The test signal is attenuated a predictable amount between array ports $14_1$ and $14_2$ and along the entire path between test source 524 and comparator 538. If comparator 538 determines the signal has been attenuated the expected amount, it indicates the path is functioning.

The setting for switches 528, 522*a*, and 522*b* described above tests one path through the switches, one path through circular lens 30, and one path through each of splitters $\mathbf{520}_1$ and $\mathbf{520}_{12}$. Also, the test verifies the operation of amplifier $\mathbf{16}_1$ and coupler $\mathbf{18}_{12}$. If testing is employed with all possible settings of switches 528, 522*a*, and 522*b*, then all the amplifiers $\mathbf{16}_1 \ldots \mathbf{16}_{22}$, all paths through circular lens 30, all paths through switches 522*a* and 522*b*, all couplers $\mathbf{518}_1 \ldots \mathbf{518}_{22}$, all couplers $\mathbf{18}_1 \ldots \mathbf{18}_{22}$, and all splitters $\mathbf{520}_1 \ldots \mathbf{520}_{22}$ will be tested. In this way, substantial portions of the system can be tested with the addition of very little hardware.

Having described one embodiment of the invention, various modifications will become apparent to one of skill in the art. For example, any number of antenna elements and array ports could be used. Moreover, the size and spacing of these elements can be varied to achieve a desired operating frequency range.

To achieve the design of the present invention, the size of the antenna array was constrained. Repeated simulations were performed using a digital computer and known techniques. In each simulation, the number of antenna elements and their size was varied to determine which combination produced an antenna which operated over the broadest frequency range. For other configurations, a similar simulation must be performed to select the design parameters of the antenna array.

Many other alterations could be employed. Other known RF components might be substituted for the ones specifically described herein. It is felt, therefore, that this invention should be limited only by the spirit and scope of the appended claims.

What is claimed is:

1. A method of operating a direction finding system with a circular antenna array and a circular lens, to determine the direction of a signal received by the system, comprising the steps of:

a) comparing the strength of a first signal at the center of the lens and the strength of a second signal formed by the lens; and b) when the strength of the second signal formed by the lens is of the same order of magnitude as the strength of the first signal at the center of the lens, using the second signal formed by the lens for computing the direction of the received signal.

2. A radio frequency system adapted for operation with signals having frequencies within a predetermined bandwidth, such predetermined bandwidth extending from a lowest frequency $f_L$ to a highest frequency $f_h$ comprising:

a circular array of antenna elements, the center-to-center spacing between the antenna elements measured along the outer circumference of the circular array being 3.5 $\lambda_H$, where $\lambda_H = c/f_H$ and where c is equal to the speed of light in free space; and additionally comprising:

a circular lens means, having a plurality of circularly disposed array ports disposed along an outer periphery of the lens means, for coupling energy fed to one of such array ports, through the lens means, to other ones of the array ports, each one of the plurality of array ports being coupled to a corresponding one of the antenna elements.

3. The radio frequency system of claim 1 wherein the array ports and the antenna elements have different dielectric media and wherein the center-to-center spacing between the array ports measured along an arc of the circularly disposed array ports is 6.65 $\lambda_H$.

4. The radio frequency system of claim 2 additionally comprising:

a circular lens having a plurality of array ports, each one of the antenna elements being coupled to a different pair of two adjacent ones of the plurality of array ports.

5. The radio frequency system of claim 4 wherein the array ports and the antenna elements have different dielectric media and wherein the spacing between the array ports is 3.3 $\lambda_H$.

6. The radio frequency system of claim 2 additionally comprising an omnidirectional probe in the center of the circular lens.

7. The radio frequency system of claim 3 additionally comprising an omnidirectional probe in the center of the circular lens.

8. A direction finding system adapted for operation with signals having frequencies within a predetermined bandwidth, such predetermined bandwidth extending from a lowest frequency $F_L$ to a highest frequency $f_H$ comprising:

a circular array of antenna elements, the spacing between antenna elements exceeding $\lambda_H$ where $\lambda_H = c/f_H$, and where c is equal to the speed of light in free space; and additionally comprising:

a circular lens means, having a plurality of array ports disposed along an outer periphery of the lens means, for coupling energy fed to one of such array ports, through the lens means, to other ones of the array ports, wherein each one of the antenna elements is electrically connected to a corresponding one of said plurality of array ports.

9. The direction finding system of claim 8 wherein each one of the plurality of antenna elements is connected to a plurality of the plurality of array ports.

10. The direction finding system of claim 9 additionally comprising:

means, switchably coupled to two adjacent ones of the connected array ports, for receiving one radio frequency signal.

11. The direction finding system of claim 10 wherein the receiving means comprises means for computing an amplitude monopulse ratio of signals received at any two adjacent ones of the connected array ports.

12. The direction finding system of claim 9 additionally comprising:

a) an omnidirectional antenna element in the center of the circular lens;

b) means for processing signals; and c) means for switchably coupling a signal received at one of the plurality of array ports to the processing means when the strength of a signal received at the omnidirectional antenna element is of the same magnitude as the signal received at said one of the array ports.

13. An antenna system adapted for operating on radio frequency signals having frequencies within a predetermined bandwidth, such predetermined bandwidth extending from a lowest frequency $f_L$ to a highest frequency $f_H$ comprising:

a) a plurality of antenna elements arranged in a circular array, such antenna elements having a center-to-center spacing greater than $\lambda_H$, where $\lambda_H = c/f_H$ and where c is the speed of light in free space, each one of the antenna elements having an antenna element radiation pattern which varies with the frequency of the radio frequency signals;

b) a radio frequency lens means having a plurality of array ports disposed about an outer periphery of such lens for coupling an RF signal at one of the array ports to selected other ones of the array ports to produce an array port radiation pattern, such array port radiation pattern being coupled through the lens to an opposing selected portion of other ones of the array ports, the portion of such other ones of the array port having energy coupled thereto being a function of the frequency of the RF signal such that the width of the array port radiation pattern varies inversely with increasing frequency, and the width of the antenna element radiation pattern varies inversely with increasing frequency, to produce an antenna pattern for the antenna system which is constant over the predetermined bandwidth.

14. The antenna system of claim 13 wherein the antenna elements form a circular array.

15. The antenna system of claim 14 wherein each antenna element has a width in excess of one-half of a wavelength of the radio frequency signal.

16. The antenna system of claim 14 wherein $f_H$ is in the range of $9f_L$.

17. The antenna system of claim 14 wherein the array ports are disposed in a circle.

18. A direction finding system comprising:

a) a circular lens having a plurality of array ports;

b) means, having two inputs, for computing the amplitude monopulse ratio of the signals at the inputs;

c) first switching means for coupling a selected one of the array ports to a first one of the inputs of the computing means;

d) second switching means for coupling a selected different one of the array ports to a second one of the inputs of the computing means;

e) means for coupling a test signal to the first switching means and to the first one of the inputs of the computing means and for controlling the first switching means to couple the test signal to the first selected one of the array ports and for controlling the second switching means to connect the selected different one of the array ports to the second input of the computing means.

19. The direction finding system of claim 18 wherein the means for coupling comprises a signal coupler in the signal path between the first switching means and the first one of the inputs of the computing means.

20. The direction finding system of claim 18 wherein the computing means also comprises processing means for determining if the amplitude monopulse ratio of the test signals applied to the first and second inputs indicates an error condition.

21. The direction finding system of claim 18 wherein the means for coupling a test signal comprises built in test circuitry including an oscillator.

* * * * *